US007628284B2

(12) United States Patent
Hurley et al.

(10) Patent No.: US 7,628,284 B2
(45) Date of Patent: Dec. 8, 2009

(54) CONTAINER AND SORBENT COMBINATION

(75) Inventors: Thomas J. Hurley, Kenmore, NY (US); Thomas H. Powers, Mayville, NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 81 days.

(21) Appl. No.: 11/251,969

(22) Filed: Oct. 17, 2005

(65) Prior Publication Data

US 2006/0032851 A1 Feb. 16, 2006

Related U.S. Application Data

(62) Division of application No. 10/786,274, filed on Feb. 25, 2004, now abandoned.

(51) Int. Cl.
*B65D 51/26* (2006.01)

(52) U.S. Cl. ..... 215/227; 215/6; 220/578; 220/521; 206/0.7

(58) Field of Classification Search ..... 220/23.87, 220/521, 578, 719; 215/6, 227, 354; 206/0.7
See application file for complete search history.

(56) References Cited

U.S. PATENT DOCUMENTS 1,342,321 A * 6/1920 Beler ..... 215/231
2,072,630 A * 3/1937 Ferry ..... 215/12.1
2,159,171 A 5/1939 McCorkhil
2,531,084 A 11/1950 Sommer
3,033,409 A * 5/1962 Lind ..... 206/540
3,075,667 A * 1/1963 Lind ..... 215/231
3,820,309 A 6/1974 Cullen et al.
4,003,490 A * 1/1977 Corbic nee Busnel ..... 220/532
4,756,436 A * 7/1988 Morita et al. ..... 215/228
4,836,424 A 6/1989 Afshar
4,939,332 A 7/1990 Hahn
5,318,183 A * 6/1994 Cohen et al. ..... 206/538
5,738,234 A * 4/1998 Harrold ..... 215/386
5,788,101 A 8/1998 King
6,164,503 A 12/2000 Forsyth et al.
6,887,924 B2 5/2005 McKedy et al.
6,929,682 B2 8/2005 Ware
2004/0256400 A1* 12/2004 DeJonge ..... 220/719

OTHER PUBLICATIONS

PCT/US05/05162 International Search Report dated Nov. 27, 2006.

* cited by examiner

*Primary Examiner*—Anthony Stashick
*Assistant Examiner*—James N Smalley
(74) *Attorney, Agent, or Firm*—Jodi A. Reynolds, Esq.; Stephen B. Salai, Esq.; Harter Secrest & Emery LLP

(57) ABSTRACT

A combination of a container body, an opening in said container body, an inner wall on said container body, a basket, a plurality of fingers on said basket engaging said inner wall, and a sorbent body in said basket.

11 Claims, 1 Drawing Sheet

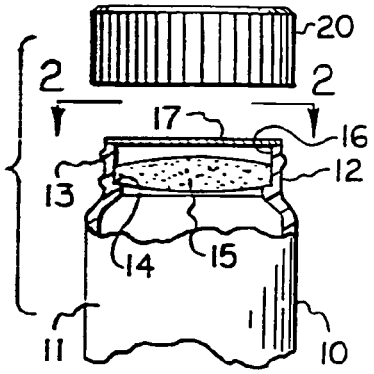
FIG. 1
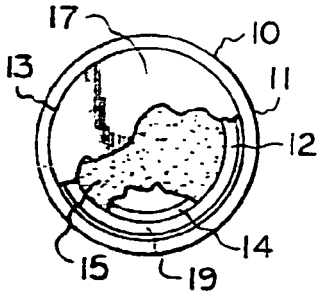
FIG. 2
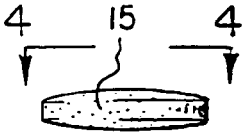
FIG. 3
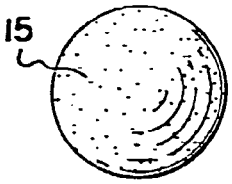
FIG. 4
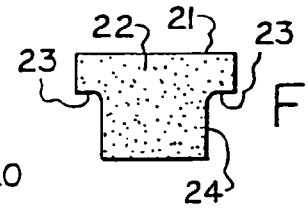
FIG. 7
FIG. 5
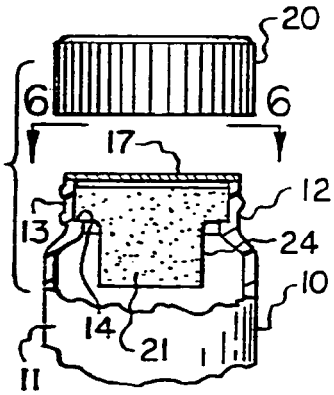
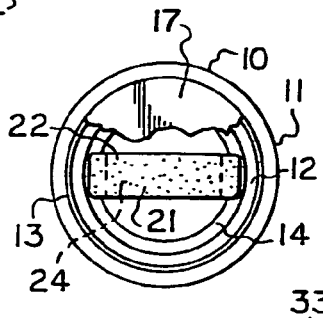
FIG. 6
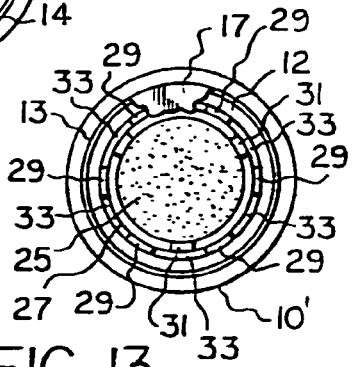
FIG. 13
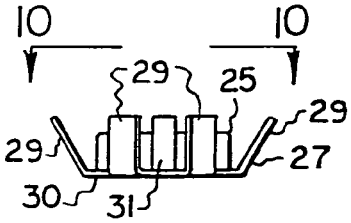
FIG. 9
FIG. 8
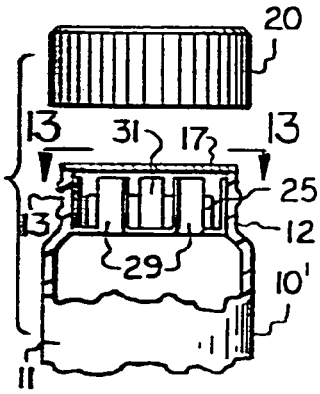
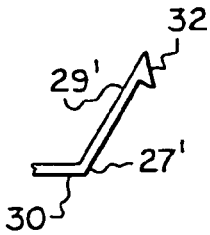
FIG. 11
FIG. 10
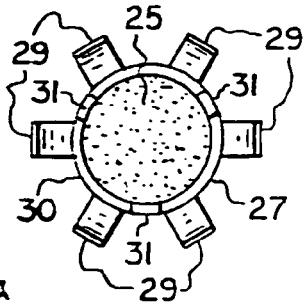
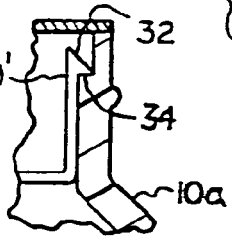
FIG. 12

CONTAINER AND SORBENT COMBINATION

CROSS-REFERENCE TO RELATED APPLICATIONS

This application is a Divisional of U.S. patent application Ser. No. 10/786,274, filed Feb. 25, 2004.

STATEMENT REGARDING FEDERALLY SPONSORED RESEARCH OR DEVELOPMENT

Not Applicable

BACKGROUND OF THE INVENTION

The present invention relates to an improved combination of a container and sorbent therein, and it also relates to a container insert for supporting a sorbent above the contents of the container.

By way of background, in the past sorbents were provided in containers for protecting the contents thereof. These sorbents were for the purpose of absorbing moisture or absorbing oxygen or other gases or odors. The sorbents, insofar as known were in the form of packets, capsules, cartridges or tablets, and they were generally mixed in with the contents of the container.

BRIEF SUMMARY OF THE INVENTION

It is one object of the present invention to provide the combination of a container and a sorbent wherein the sorbent is supported in the container out of contact with the contents thereof.

It is another object of the present invention to provide an insert for a container which supports a sorbent out of contact with the contents of the container. Other objects and attendant advantages of the present invention will readily be perceived hereafter.

The present invention relates to the combination of a container body, an opening in said container body, an inner wall on said container body, a ledge on said inner wall proximate said opening, a sorbent body, and an edge on said sorbent body overlying and supported by said ledge.

The present invention also relates to the combination of a container body, an opening in said container body, an inner wall on said container body, a basket, a plurality of fingers on said basket engaging said inner wall, and a sorbent body in said basket.

The present invention also relates to a container insert for supporting a body within a container comprising a basket, a base on said basket, and a plurality of fingers resiliently mounted relative to said base and extending outwardly at an obtuse angle relative to said base.

The various aspects of the present invention will be readily understood when the following portions of the specification are read in conjunction with the accompanying drawings wherein:

BRIEF DESCRIPTION OF THE SEVERAL VIEWS OF THE DRAWING(S)

FIG. 1 is a fragmentary partially broken away exploded view of one embodiment of the improved container and sorbent combination of the present invention having a sorbent supported on a ledge therein;

FIG. 2 is a partially broken away view taken substantially in the direction of arrows 2-2 of FIG. 1;

FIG. 3 is a side elevational view of the sorbent of FIG. 1;

FIG. 4 is a plan view of the sorbent taken substantially in the direction of arrows 4-4 of FIG. 3;

FIG. 5 is a fragmentary partially broken away exploded view of another embodiment of a container and sorbent combination but supporting a sorbent of a different shape;

FIG. 6 is a partially broken away view taken substantially in the direction of arrows 6-6 of FIG. 5;

FIG. 7 is a side elevational view of the sorbent of FIGS. 5 and 6;

FIG. 8 is a fragmentary partially broken away exploded view of another embodiment of a container and sorbent combination wherein there is a container insert in the form of a basket for supporting a sorbent;

FIG. 9 is a side elevational view of the container insert of FIG. 8 and which supports a sorbent thereon;

FIG. 10 is a plan view taken substantially in the direction of arrows 10-10 of FIG. 9;

FIG. 11 is a fragmentary side elevational view of a modification of the container insert of FIGS. 8-10;

FIG. 12 is a fragmentary cross sectional view of a neck of a container which receives the modified container insert of FIG. 11; and FIG. 13 is a fragmentary plan view showing the clearance between the container insert and the inner wall of the container.

DETAILED DESCRIPTION OF THE INVENTION

One embodiment of the container and sorbent combination is disclosed in FIGS. 1-4. In this embodiment a container 10 includes a container body 11 which can receive any type of product which must have associated therewith a sorbent for absorbing moisture or absorbing oxygen or any other type of gaseous material. The container 10 can be for pharmaceuticals, or electronic components, or food, or, as noted above, any item which requires the presence of a sorbent. The container 10 may be fabricated of glass or plastic or any other type of material. The container body 11 includes a cylindrical neck 12 having a cap-receiving thread 13 thereon. On the inner wall 16 of neck 12 is a sorbent support in the nature of a circular lip or ledge on which is supported a sorbent 15 in the form of a solid circular disc. An induction seal 17 is secured to the edge 19 of neck 12. A cap 20 screws onto threads 13. However, it will be appreciated that while the induction seal is desirable, it may not be required for certain applications. A typical induction seal and cap arrangement is shown in U.S. Pat. No. 6,164,503.

The sorbent 15 is fabricated from a suitable desiccant or oxygen-absorber or odor-absorber by compressing granular material with a binder and optionally coating it with a coating to prevent dusting thereof. One type of pressed sorbent is disclosed in U.S. Pat. No. 6,887,924, issued May 30, 2005 and a type of pressed and coated sorbent is disclosed in U.S. Pat. No. 6,929,682, issued Aug. 16, 2005, both of which are incorporated by reference. It will further be appreciated that the sorbent need not be of the foregoing described types but may be of the type wherein the sorbent is placed within a capsule or cartridge and is of a shape which will fit on ledge 14. The advantage of all of the foregoing is that the sorbent is not in direct contact with the contents of container 10. Also, the sorbent is confined against excessive movement by being located between the ledge 14, neck wall 12 and seal 17.

Another embodiment of the present invention is disclosed in FIGS. 5-7 wherein the container 10 and cap 20 and seal 17 are identical to the container of FIG. 1 and identical numerals depict identical elements of structure. However, the embodiment of FIGS. 5-7 carries a sorbent 21 of a substantially solid T-shape wherein the top 22 of the T is of a length such that its lower edges 23 will rest on ledge 14. It also has a depending portion 24 which extends into the body of the container. The advantage of the foregoing structure is that the depending portion 24 can be made of various sizes to meet the sorbent requirements of the product within the container. Also, while the dependent portion 24 is of substantially solid rectangular form, it will be appreciated that it can be cylindrical or any other shape.

In FIGS. 8-10 yet another embodiment of the present invention is disclosed. In this embodiment the container 10' differs from that of the preceding figures in that it does not have a sorbent support in the form of an annular ledge 14. However, all of the other parts can be identical and are represented by identical numerals.

In the embodiment of FIGS. 8-10 the support for sorbent 25 of cylindrical form is a container insert in the form of a basket or carrier 27 which is fabricated from molded plastic and has a plurality of flexible fingers 29 which are resiliently mounted on and extend outwardly from circular base 30 at an obtuse angle shown in FIG. 9. The basket or carrier 27 is inserted into the neck 12 and the resiliently-mounted fingers 29 are moved from the position of FIG. 9, wherein they extend outwardly at an obtuse angle relative to base 30, to the position of FIG. 8 wherein they are biased against the inner surface of neck 12 with a friction fit. The sorbent 25 is thereafter placed on the base 30. In this instance the sorbent can be of any desired shape or it can be a cartridge or capsule or even a packet. A plurality of tabs 31 extend upwardly from base 30 toward the opening of the container. In use, after the container 10' has been opened and the seal 17 has been broken, the sorbent 25 and the retainer 27 can be removed by grasping and pulling any one of tabs 31. In use, there is communication between the contents of container 10' and sorbent 25 through the clearances 33 between base 30 and container 10'.

In FIG. 11 a modified container insert 27' is shown wherein the only difference from container insert 27 of FIGS. 8-10 is that the fingers 29' have a protrusion in the form of a barb 32 at the outer ends thereof which engage and rest on circular ledge 34 of container 10*a*. The protrusions 32 need only be on some of the fingers.

While all of the containers 10, 10' and 10*a* have been shown as having a neck, it will be appreciated that the present subject is equally applicable to containers which have a straight body without a neck of the type which is shown in the drawings.

While preferred embodiments of the present invention have been disclosed, it will be appreciated that it is not limited thereto, but may be otherwise embodied within the scope of the following claims.

The invention claimed is:

1. In combination, a container and a basket comprising:

said container having a sealable opening and a neck formed in said container extending from said sealable opening, said neck having an inner spaced apart from said sealable opening;

said basket disposed in a fixed position within said neck and having a plurality of generally longitudinally extending resilient fingers moveable between a noncompressed position and a compressed position, a top portion of said resilient fingers having a diameter that is greater than said diameter of said neck in said noncompressed position and less than said diameter of said neck in said compressed position;

a protrusion projecting radially outwardly from at least two diametrically opposed ones of said plurality of resilient fingers, said protrusions engaging said inner ledge of said neck to locate said top portion of said resilient fingers below said sealable opening; and a sorbent body in said basket.

2. A combination as set forth in claim 1 including a seal across said sealable opening spaced from the top portions of the resilient fingers.

3. A combination as set forth in claim 2 including a cap mounted across said sealable opening on said opposite side of said seal from said sorbent body.

4. A combination as set forth in claim 1 including a cap mounted across said sealable opening.

5. A combination as set forth in claim 1 including a grasping tab on said basket extending upwardly toward said sealable opening.

6. A combination as set forth in claim 5 including a seal across said sealable opening spaced from the top portions of the resilient fingers.

7. A combination as set forth in claim 6 including a cap mounted across said opening on said opposite side of said seal from said sorbent body.

8. A combination as set forth in claim 5 including a cap mounted across said opening.

9. A combination as set forth in claim 1, wherein said basket is arranged so that the fingers frictionally fit within said neck.

10. A combination as set forth in claim 1, wherein said basket comprises a base and said resilient fingers are compressed from an obtuse angle position relative to said base to a generally right angle position relative to said base.

11. A combination as set forth in claim 1, wherein said protrusions are barbs.

* * * * *